US006500219B1

(12) United States Patent
Gunnerman

(10) Patent No.: US 6,500,219 B1
(45) Date of Patent: Dec. 31, 2002

(54) CONTINUOUS PROCESS FOR OXIDATIVE DESULFURIZATION OF FOSSIL FUELS WITH ULTRASOUND AND PRODUCTS THEREOF

(75) Inventor: Rudolf W. Gunnerman, Reno, NV (US)

(73) Assignee: Sulphco, Inc., Reno, NV (US)

( * ) Notice: Subject to any disclaimer, the term of this patent is extended or adjusted under 35 U.S.C. 154(b) by 0 days.

(21) Appl. No.: 09/812,390

(22) Filed: Mar. 19, 2001

(51) Int. Cl.[7] ..... C10L 1/00
(52) U.S. Cl. ..... 44/904; 44/628; 208/208 R
(58) Field of Search ..... 44/301, 622, 628, 44/904; 208/208 R

(56) References Cited

U.S. PATENT DOCUMENTS 4,391,608 A * 7/1983 Dondelewski ..... 201/17
4,725,287 A 2/1988 Gregoli et al.
4,978,365 A 12/1990 Gregoli et al.
5,000,872 A 3/1991 Olah
5,110,443 A 5/1992 Gregoli et al.
5,198,122 A * 3/1993 Koszalka et al. ..... 134/1
5,753,102 A * 5/1998 Funakoshi et al. ..... 208/208 R
5,824,214 A 10/1998 Paul et al.
5,961,820 A 10/1999 Jeanblanc et al.

FOREIGN PATENT DOCUMENTS

WO WO/00/15734 3/2000

* cited by examiner

*Primary Examiner*—Cephia D. Toomer
(74) *Attorney, Agent, or Firm*—Townsend and Townsend and Crew, LLP

(57) ABSTRACT

Fossil fuels are combined with a hydroperoxide, a surface active agent, and an aqueous liquid to form an aqueous-organic reaction medium which is passed through an ultrasound chamber on a continuous flow-through basis. The emerging mixture separates spontaneously into aqueous and organic phases, from which the organic phase is readily isolated as the desulfurized fossil fuel.

28 Claims, No Drawings

CONTINUOUS PROCESS FOR OXIDATIVE DESULFURIZATION OF FOSSIL FUELS WITH ULTRASOUND AND PRODUCTS THEREOF

BACKGROUND OF THE INVENTION

1. Field of the Invention

This invention resides in the field of the desulfurization of petroleum and petroleum-based fuels.

2. Description of the Prior Art

Fossil fuels are the largest and most widely used source of power in the world, offering high efficiency, proven performance, and relatively low prices. There are many different types of fossil fuels, ranging from petroleum fractions to coal, tar sands, and shale oil, with uses ranging from consumer uses such as automotive engines and home heating to commercial uses such as boilers, furnaces, smelting units, and power plants.

Unfortunately, most fossil fuels contain sulfur, typically in the form of organic sulfur compounds. The sulfur causes corrosion in pipeline, pumping, and refining equipment, as well as the premature failure of combustion engines. Sulfur also poisons the catalysts used in the refining and combustion of fossil fuels. By poisoning the catalytic converters in automotive engines, sulfur is responsible in part for the emissions of oxides of nitrogen ($NO_x$) from diesel-powered trucks and buses. Sulfur is also responsible for the particulate (soot) emissions from trucks and buses since high-sulfur fuels tend to degrade the soot traps that are used on these vehicles. One of the greatest problems caused by sulfur compounds is their conversion to sulfur dioxide when the fuel is burned. When released to the atmosphere results in acid rain, sulfur dioxide causes acid deposition that is harmful to agriculture, wildlife, and human health.

The Clean Air Act of 1964 addresses the problem of sulfur in fossil fuels, and the Act and its various amendments have imposed sulfur emission standards that are difficult and expensive to meet. Pursuant to the Act, the United States Environmental Protection Agency has set an upper limit on the sulfur content of diesel fuel of 15 parts per million by weight (ppmw), effective in mid-2006, a severe reduction from the standard of 500 ppmw as of the filing date of the present application. For reformulated gasoline, the standard as of the fling date of this application is 300 ppmw, and has been lowered by the EPA to 30 ppmw, effective January 1, 2004. Similar changes have been enacted in the European Union, which will enforce a limit of 50 ppmw on the sulfur limit for both gasoline and diesel fuel in the year 2005. Because of these regulatory actions, there is a continuing need for more effective desulfurization methods. The treatment of fuels to achieve sulfur emissions low enough to meet these requirements is difficult and expensive, and this inevitably results in increased fuel prices which have a major influence on the world economy.

The principal method of fossil fuel desulfurization in the prior art is hydrodesulfurization, by which the fossil fuel is reacted with hydrogen gas at elevated temperature and pressure in the presence of a catalyst. This causes the reduction of organic sulfur to gaseous $H_2S$, which is then oxidized to elemental sulfur by the Claus process. A considerable amount of unreacted $H_2S$ remains however, creating serious health hazards. Another difficulty with hydrodesulfurization is that when it is performed under the more stringent conditions needed to achieve the lower sulfur levels, the risk of hydrogen leaking through walls of the reactor increases.

Hydrodesulfurization also has limitations in terms of the types of organic sulfur compounds that it can remove. Mercaptans, thioethers, and disulfides, for example, are relatively easy to remove by the process, while other sulfur-bearing organic compounds such as aromatic compounds, cyclic compounds, and condensed multicyclic compounds are more difficult. Thiophene, benzothiophene, dibenzothiophene, other condensed-ring thiophenes, and substituted versions of these compounds are particularly difficult to remove by hydrodesulfurization. These compounds account for as much as 40% of the total sulfur content of crude oils from the Middle East and 70% of the sulfur content of West Texas crude oil. The reaction conditions needed to remove these compounds are so harsh that attempts to remove them often cause degradation of the fuel itself, thereby lowering the quality of the fuel.

Of possible relevance to this invention is co-pending U.S. patent application Ser. No. 09/676,260, entitled "Oxidative Desulfurization of fossil Fuels With Ultrasound," Teh Fu Yen, et al., inventors, filed Sep. 28, 2000. Application Ser. No. 09/676,260 is incorporated herein by reference in its entirety for all legal purposes capable of being served thereby, now U.S. Pat. No. 6,402,939.

SUMMARY OF THE INVENTION

It has now been discovered that organic sulfur compounds can be removed from a fossil (or petroleum-derived) fuel by a continuous process that applies ultrasound to a multiphase reaction medium that contains the fuel, an aqueous fluid, a hydroperoxide oxidizing agent, and a surface active agent, the reaction medium spontaneously separating into aqueous and organic phases after the ultrasound treatment, thereby enabling the immediate recovery of the desulfurized fossil fuel as the organic phase by simple phase separation. The invention resides in a continuous flow-through system in which the fossil fuel, the aqueous fluid, the hydroperoxide, and the surface active agent are fed as a multiphase aqueous-organic reaction medium to an ultrasound chamber in which ultrasound is applied to the mixture, and the reaction medium emerging from the chamber is allowed to settle into separate aqueous and organic phases. The organic phase then constitutes the desulfurized fuel which is readily removable from the aqueous phase by simple decantation. The invention further resides in the process performed by the system as well as the desulfurized fuel produced by the process. The product is unique among fossil fuels in view of its high ignition quality (low ignition delay as measured, for example, by the octane number for gasoline and the cetane number for diesel fuel) and a low API gravity, both relative to untreated fossil fuels and to fossil fuels that have been desulfurized by other processes.

The terms "desulfurized" and "sulfur-depleted" are used herein interchangeably, and both are intended to encompass fuels that contain no sulfur compounds (or a level of sulfur in any form, including molecular sulfur and organic and inorganic sulfur compounds, that is undetectable by conventional methods of detection) and fuels whose sulfur content (either in molecular form or in organic or inorganic sulfur compounds) is substantially reduced from that of the starting fossil fuel, and preferably below any of the upper limits imposed by regulation as mentioned above.

Certain organic sulfur compounds that are typically present in fossil fuels are illustrative of the effectiveness of the process. These compounds are dibenzothiophene and related sulfur-bearing organic sulfides. These compounds are the most refractory organic sulfur compounds in fossil fuels. Although other explanations are possible, it is believed that these sulfides are converted to the corresponding sulfones by this process, the sulfones having greater solubility in the aqueous phase and therefore more readily removable by separation of the phases. The ultrasound-promoted oxidation that occurs in the practice of this invention is selective toward the sulfur-bearing compounds of the fossil fuel, with little or no oxidative effect in the non-sulfur-bearing components of the fuel. The continuous flow-through nature of this invention permits a large quantity of fossil fuel to be treated at a modest operating cost and a low residence time in the ultrasound chamber. These and other advantages, features, applications and embodiments of the invention are made more apparent by the description that follows.

DETAILED DESCRIPTION OF THE INVENTION AND SPECIFIC EMBODIMENTS

The term "liquid fossil fuels" is used herein to denote any carbonaceous liquid that is derived from petroleum, coal, or any other naturally occurring material and that is used to generate energy for any kind of use, including industrial uses, commercial uses, governmental uses, and consumer uses. Included among these fuels are automotive fuels such as gasoline, diesel fuel, kerosene and other jet fuels, and rocket fuel, as well as crude oil, shale oil, liquefied petroleum gas, and petroleum residuum-based fuel oils including bunker fuels and residual fuels. Bunker fuels are heavy residual oils used as fuel by ships and industry and in large-scale heating installations. No. 6 fuel oil, which is also known as "Bunker C" fuel oil, is used in oil-fired power plants as the major fuel and is also used as a main propulsion fuel in deep draft vessels in the shipping industry. No. 4 fuel oil and No. 5 fuel oil are used to heat large buildings such as schools, apartment buildings, and office buildings, and large stationary marine engines. The heaviest fuel oil is the vacuum residuum from the fractional distillation, commonly referred to as "vacuum resid," with a boiling point of 565° C. and above, which is used as asphalt and coker feed. The present invention is useful in reducing the sulfur content of any of these fuels and fuel oils. In certain embodiments of the invention, the liquid fossil fuel is diesel fuel, either straight-run diesel fuel, rack diesel fuel (as commercially available to consumers at gasoline stations), and blends of straight-run diesel and light cycle oil, the blends ranging from 50:50 to 90:10 (straight-run:light cycle oil).

The degree of sulfur depletion achieved by this invention will vary depending on the composition of the starting fuel, including the amount of total sulfur present in the fuel, and the forms in which the sulfur is present. The degree of sulfur depletion will also vary depending on the ultrasound conditions and whether or not the product is recycled to the ultrasound chamber before final recovery, and if so, the number of recycles performed. In most cases, the invention will result in a product fuel having a total sulfur content of less than 100 ppm (all ppm units in this specification are on a weight basis), preferably less than 50 ppm, more preferably less than 25 ppm, and most preferably less than 15 ppm.

As noted above, many and possibly all of the products produced by the process described herein have a significantly increased ignition performance, which both renders the products unique and makes them particularly useful as fuels. The cetane index, also referred to in the art as the "cetane number," is of particular interest in diesel fuel, and diesel fuels can be produced by the process of this invention which have a cetane index of greater than 50.0, or preferably greater than 60.0. In terms of ranges, the invention is capable of producing diesel fuels having a cetane index of from about 50.0 to about 80.0, and preferably from about 60.0 to about 70.0. The cetane index or number has the same meaning in this specification that it has among those skilled in the art of automotive fuels. Similar improvements are obtained in gasolines in terms of the octane rating.

As also noted above, many and possibly all of the products produced by this invention have a reduced API gravity. The term "API gravity" is used herein as it is among those skilled in the art of petroleum and petroleum-derived fuels. In general, the term represents a scale of measurement adopted by the American Petroleum Institute, the values on the scale decreasing as specific gravity values increase. The scale extends from 0.0 (equivalent to a specific gravity of 1.076) to 100.0 (equivalent to a specific gravity of 0.6112). In the case of diesel fuels treated in accordance with this invention, the API gravity of the product fuel is preferably greater than 30.0, and most preferably greater than 40.0. In terms of ranges, the preferred API gravity of the diesel product is from about 30.0 to about 60.0, and most preferably from about 40.0 to about 50.0.

The term "hydroperoxide" is used herein to denote a compound of the molecular structure in which R represents either a hydrogen atom or an organic or inorganic group. Examples of hydroperoxides in which R is an organic group are water-soluble hydroperoxides such as methyl hydroperoxide, ethyl hydroperoxide, isopropyl hydroperoxide, n-butyl hydroperoxide, sec-butyl hydroperoxide, tert-butyl hydroperoxide, 2-methoxy-2-propyl hydroperoxide, tert-amyl hydroperoxide, and cyclohexyl hydroperoxide. Examples of hydroperoxides in which R is an inorganic group are peroxonitrous acid, peroxophosphoric acid, and peroxosulfuric acid. Preferred hydroperoxides are hydrogen peroxide (in which R is a hydrogen atom) and tertiary-alkyl peroxides, notably tert-butyl peroxide.

The aqueous fluid that is combined with the fossil fuel and the hydroperoxide may be water or any aqueous solution. The relative amounts of liquid fossil fuel and water may vary, and although they may affect the efficiency of the process or the ease of handling the fluids, the relative amounts are not critical to this invention. In most cases, however, best results will be achieved when the volume ratio of fossil fuel to aqueous fluid is from about 8:1 to about 1:5, preferably from about 5:1 to about 1:1, and most preferably from about 4:1 to about 2:1.

The amount of hydroperoxide relative to the fossil fuel and the aqueous fluid can also be varied, and although the conversion rate may vary somewhat with the proportion of hydroperoxide, the actual proportion is not critical to the invention, and any excess amounts will be eliminated by the ultrasound. When the hydroperoxide is $H_2O_2$, best results will generally be achieved in most systems with an $H_2O_2$ concentration within the range of from about 0.0003% to about 0.03% by volume (as $H_2O_2$) of the combined aqueous and organic phases, and preferably from about 0.001% to about 0.01%. For hydroperoxides other than $H_2O_2$, the preferred relative volumes will be those of equivalent molar amounts.

The surface active agent used in the practice of this invention is any surface active agent that will promote the formation of an emulsion between the starting fossil fuel and the aqueous fluid upon passing the liquids through a common mixing pump, and that will spontaneously separate the product liquids into aqueous and organic phases suitable for immediate separation by decantation or other simple phase separation procedures. The preferred surface active agent is a liquid aliphatic $C_{15}$–$C_{20}$ hydrocarbon or mixtures of such hydrocarbons, preferably having a specific gravity of at least about 0.82, and most preferably at least about 0.85. Examples of hydrocarbon mixtures that meet this description and are particularly convenient for use and readily available are mineral oils, preferably heavy or extra heavy mineral oil. The terms "mineral oil," "heavy mineral oil," and "extra heavy mineral oil" are well known in the art and are used herein in the same manner as they are commonly used in the art. Such oils are readily available from commercial chemicals suppliers throughout the world. The amount of surface active agent used is any amount that will perform as described above. The amount is otherwise not critical and may vary depending on the grade of mineral oil, the fuel composition, the relative amounts of aqueous and organic phases, and the operating conditions. Appropriate selection will be a matter of routine choice and adjustment to the skilled engineer. In the case of mineral oil, best and most efficient results will generally be obtained using a volume ratio of mineral oil to liquid fossil fuel of from about 0.00003 to about 0.003.

In certain embodiments of the invention, a metallic catalyst is included in the reaction system to regulate the activity of the hydroxyl radical produced by the hydroperoxide. Examples of such catalysts are transition metal catalysts, and preferably metals having atomic numbers of 21 through 29, 39 through 47, and 57 through 79. Particularly preferred metals from this group are nickel, sulfur, tungsten (and tungstates), and combinations thereof. In certain systems within the scope of this invention, Fenton catalysts (ferrous salts) and metal ion catalysts in general such as iron (II), iron (III), copper (I), copper (II), chromium (III), chromium (VI), molybdenum, tungsten, and vanadium ions, are useful. Of these, iron (II), iron (III), copper (II), and tungsten catalysts are preferred. For some systems, such as crude oil, Fenton-type catalysts are preferred, while for others, such as diesel and other systems where dibenzothiophene is a prominent component, tungstates are preferred. Tungstates include tungstic acid, substituted tungstic acids such as phosphotungstic acid, and metal tungstates. The metallic catalyst when present will be used in a catalytically effective amount, which means any amount that will enhance the progress of the reaction (i.e., increase the reaction rate) toward the desired goal, particularly the oxidation of the sulfides to sulfones. The catalyst may be present as metal particles, pellets, or other similar forms, retained in the ultrasound chamber by physical barriers or other restraining means as the reaction medium is allowed to pass through.

A further improvement in efficiency of the invention is often achievable by preheating the fossil fuel, the aqueous fluid, or both, prior to entry of these fluids into the ultrasound chamber. The optimal degree of preheating will vary with the particular fossil fuel and the ratio of aqueous to organic phases. With diesel fuel, for example, best results will most often be obtained by preheating the fuel to a temperature of at least about 70° C., and preferably from about 70° C. to about 80°. Care should be taken however not to volatilize the fuel. The aqueous phase may be preheated to any temperature up to its boiling point.

Ultrasound used in accordance with this invention consists of soundlike waves whose frequency is above the range of normal human hearing, i.e., above 20 kHz (20,000 cycles per second). Ultrasonic energy with frequencies as high as 10 gigahertz (10,000,000,000 cycles per second) has been generated, but for the purposes of this invention, useful results will be achieved with frequencies within the range of from about 20 kHz to about 200 kHz, and preferably within the range of from about 20 kHz to about 50 kHz. Ultrasonic waves can be generated from mechanical, electrical, electromagnetic, or thermal energy sources. The intensity of the sonic energy may also vary widely. For the purposes of this invention, best results will generally be achieved with an intensity ranging from about 30 watts/cm$^2$ to about 300 watts/cm$^2$, or preferably from about 50 watts/cm$^2$ to about 100 watts/cm$^2$. The typical electromagnetic source is a magnetostrictive transducer which converts magnetic energy into ultrasonic energy by applying a strong alternating magnetic field to certain metals, alloys and ferrites. The typical electrical source is a piezoelectric transducer, which uses natural or synthetic single crystals (such as quartz) or ceramics (such a barium titanate or lead zirconate) and applies an alternating electrical voltage across opposite faces of the crystal or ceramic to cause an alternating expansion and contraction of crystal or ceramic at the impressed frequency. Ultrasound has wide applications in such areas as cleaning for the electronics, automotive, aircraft, and precision instruments industries, flow metering for closed systems such as coolants in nuclear power plants or for blood flow in the vascular system, materials testing, machining, soldering and welding, electronics, agriculture, oceanography, and medical imaging. The various methods of producing and applying ultrasonic energy, and commercial suppliers of ultrasound equipment, are well known among those skilled in the use of ultrasound.

The residence time of the multiphase reaction medium in the ultrasound chamber is not critical to the practice or to the success of the invention, and the optimal residence time will vary according to the type of fuel being treated. An advantage of the invention however is that effective and useful results can be achieved with a relatively short residence time. A preferred range of residence times is from about 0.3 minute to about 30 minutes, and a more preferred range is from about 0.5 minute to about 5 minutes.

Still further improvements in the efficiency and effectiveness of the process can be achieved by recycling the organic phase to the ultrasound chamber with a fresh supply of water. Recycle can be repeated for a total of three passes through the ultrasound chamber for even better results. Alternatively, the organic phase emerging from the ultrasound chamber can be subjected to a second stage ultrasound treatment, and possibly a third stage ultrasound treatment, with a fresh supply of water at each stage.

Although a large amount of sulfur compounds will have been extracted into the aqueous phase, the organic phase emerging from the ultrasound chamber may contain residual amounts of sulfur compounds. A convenient way to remove these compounds is by conventional methods of extracting polar compounds from a non-polar liquid medium these methods include solid-liquid extraction, using adsorbents such as silica gel, activated alumina, polymeric resins, and zeolites. Liquid-liquid extraction can also be used, with polar solvents such as dimethyl formamide, N-methylpyrrolidone, or acetonitrile. A variety of organic solvents that are either immiscible or marginally miscible with the fossil fuel, can be used. Toluene and similar solvents are examples.

The ultrasound-assisted oxidation reaction generates heat, and with certain fossil fuels it is preferable to remove some of the generated heat to maintain control over the reaction. When gasoline is treated in accordance with this invention, for example, it s preferable to cool the reaction medium in the ultrasound chamber. Cooling is readily achievable by conventional means, such as the use of a liquid coolant jacket or a coolant circulating through the interior of the ultrasound chamber as for example in a cooling coil. Water at atmospheric pressure is an effective coolant for these purposes. When cooling is achieved by immersing the ultrasound chamber in a coolant bath or circulating coolant, the coolant may be at a temperature of about 50° C. or less, preferably about 20° C. or less, and more preferably within the range of from about −5° C. to about 20° C. Suitable cooling methods or devices will be readily apparent to those skilled in the art. Cooling is generally unnecessary with diesel fuel.

The following examples are offered for purposes of illustration and are not intended to limit the scope of the invention.

EXAMPLE 1

An illustrative desulfurization system in accordance with the present invention used a stainless steel ultrasound chamber having an internal volume of 3 liters, and diesel fuel and water as the fossil fuel and aqueous fluids, respectively, at three parts by volume of diesel ful to one part by volume of water. The diesel fuel was preheated to a temperature of about 75° C.; the water was not preheated. The hydroperoxide was hydrogen peroxide, added to the water as a 3% (by weight) aqueous solution, at 0.0025 parts by volume of the solution to one part by volume of the water. The surface active agent was extra heavy mineral oil, obtained from Mallinckrodt Baker Inc., Philipsburg, N.J., USA, added to the diesel at approximately 0.001 part by volume of the mineral oil to one part by volume of the diesel. The entire mixture was passed into the ultrasound at a flow rate of approximately 1 gallon per minute (3.8 liters/min) at approximately atmospheric pressure. the ultrasound chamber contained a metal (stainless steel) screen on which rested approximately 25 grams each of silver and nickel pellets, each approximately one-eighth inch (0.3 cm) in diameter).

Ultrasound was supplied to the ultrasound chamber by an ultrasound probe suspended from above with its lower end terminating approximately 5 cm above the metal pellets. Ultrasound was supplied to the probe by an ultrasound generator as follows:

Ultrasound generator:

Supplier: Sonics & Materials, Inc., Newtown, Conn., USA

Power supply: net power output of 800 watts (run at 50%)

Voltage: 120 V, single phase

Current: 10 amps

Frequency: 20 kHz

The two-phase mixture emerging from the ultrasound chamber passed through two cloth filters into a separation chamber, from the top of which desulfurized diesel was drawn, while from the bottom of which the aqueous phase were drawn. Sulfur analyses were performed on a sulfur analyzer Model SLFA-20, supplied by Horiba Instruments, Inc., Knoxville, Tenn., USA, with a detection limit of 20 ppm.

The diesel emerging from a single pass through the ultrasound chamber and separator was washed with toluene to remove any sulfur remaining in the organic phase. Alternatively, the organic phase was recycled through the ultrasound chamber with fresh water at the same ratios and conditions used in the first pass. When recycling was performed twice, the sulfur content of the organic phase with a solvent wash was substantially the same as that achieved with a single pass followed by the solvent wash.

Experiments were also performed using other surfactants in place of the mineral oil. These included the following, all tested individually with the same proportions and under the same conditions as in the mineral oil test:

XTOL® tall oil fatty acids, obtained from Georgia Pacific Resins, Inc.

PLURONIC® 25 R-2, a poly(propylene oxide b-ethylene oxide), obtained from BASF Wyandotte Co.

TETRONIC 304, a poly(propylene oxide b-ethylene oxide), obtained from BASF Wyandotte Co.

ARMAK® 1703, alkoxylated fatty amines, obtained from AKZO Nobel EMULSOGEN® A, obtained from Hoechst Celanese None of the five surfactants immediately above produced an emulsion that would spontaneously separate into aqueous and organic phases upon emergence from the ultrasound chamber.

EXAMPLE 2

70/30 SR diesel fuel (a blend of 70% straight-run diesel and 30% light cycle oil, by volume) both before and after treatment under the operating conditions set forth in Example 1 was analyzed for kinematic viscosity, total nitrogen, and sulfur components, with results shown in Table 1.

TABLE I

| Test | Method | Feed | Product |
|---|---|---|---|
| Kinematic Viscosity (cSt @ 122° F.) | ASTM D-445 | 2.39 | |
| Kinematic Viscosity (cSt @ 100° F.) | ASTM D-445 | 3.04 | |
| Total N by Chemiluminescence (ppm wt) | ASTM D-4629 | | |
| Sulfur Components (ppm wt S) | ASTM D-5623 | | |
| hydrogen sulfide | | <1 | <1 |
| sulfur dioxide | | <1 | <1 |
| carbonyl sulfide | | <1 | <1 |
| ethyl mercaptan | | <1 | <1 |
| methyl sulfide | | <1 | <1 |
| carbonyl disulfide | | <1 | <1 |
| isopropyl mercaptan | | <1 | <1 |
| ethylene sulfide | | <1 | <1 |
| t-butyl mercaptan | | <1 | <1 |
| n-propyl mercaptan | | <1 | <1 |
| ethyl methyl sulfide | | <1 | <1 |
| thiophene | | <1 | <1 |
| sec-butyl mercaptan | | <1 | <1 |
| isobutyl mercaptan | | <1 | <1 |
| ethyl sulfide | | <1 | <1 |
| n-butyl mercaptan | | <1 | <1 |
| methyl disulfide | | <1 | <1 |
| 2-methyl thiophene | | <1 | <1 |
| 3-methyl thiophene | | <1 | <1 |
| tetrahydrothiophene | | <1 | <1 |
| ethyl methyl disulfide | | <1 | <1 |
| 2-ethyl thiophene | | <1 | <1 |
| 2,5-dimethyl thiophene | | <1 | <1 |
| 3-ethyl thiophene | | <1 | <1 |
| 2,4 & 2,3-dimethyl thiophene | | <1 | <1 |
| 3,4-dimethyl thiophene | | <1 | <1 |
| methyl ethyl thiophenes | | <1 | <1 |
| trimethyl thiophenes | | <1 | <1 |
| tetramethyl thiophenes | | <1 | <1 |
| benzothiophene | | 10 | <1 |
| methyl benzothiophenes | | 186 | <1 |
| dimethyl benzothiophenes | | 486 | 1 |
| trimethyl benzothiophenes | | 490 | 3 |
| tetramethyl benzothiophenes | | 464 | 14 |
| dibenzothiophene | | 169 | 2 |
| methyl dibenzothiophenes | | 395 | 10 |
| dimethyl dibenzothiophenes | | 450 | 12 |
| trimethyl dibenzothiophenes | | 215 | 9 |

TABLE I-continued

| Test | Method | Feed | Product |
|---|---|---|---|
| unidentified volatile sulfur | | 396 | 18 |
| Total Sulfur by X-Ray Spectroscopy (wt %) | ASTM D-2622 | 0.3260 | 0.007 |

The same 70/30 SR diesel fuel both before and after treatment was given a full chemical analysis by ASTM D-5134 Mod., with results shown in Table II.

TABLE II

| | Feed (weight %) | Product (weight %) |
|---|---|---|
| n-hexane | 0.01 | |
| cyclohexane | 0.01 | |
| trans-1,2-dimethylcyclopentane | 0.01 | |
| n-heptane | 0.02 | |
| methylcyclohexane | 0.03 | |
| trans,cis-1,2,3-trimethylcyclopentane | 0.01 | |
| N,N-dimethyl formamide | | 0.30 |
| toluene | 0.01 | 0.19 |
| 2-methylheptane | 0.01 | |
| 3-methylheptane | 0.02 | 0.01 |
| trans-1,2-dimethylcyclohexane | 0.01 | 0.01 |
| n-octane | 0.06 | 0.03 |
| cis-1,2-dimethylcyclohexane | | 0.01 |
| 2,4-dimethylheptane | | 0.01 |
| ethylcyclohexane | 0.02 | 0.06 |
| 2,6-dimethylheptane | 0.01 | 0.01 |
| 1,1,3-trimethylcyclohexane | 0.01 | 0.06 |
| 2,5-dimethylheptane | | 0.01 |
| 3,5-dimethylheptane | | 0.01 |
| ethylbenzene | 0.01 | 0.02 |
| trans,trans-1,2,4-trimethylcyclohexane | 0.01 | 0.05 |
| meta-xylene | 0.02 | |
| para-xylene | 0.01 | |
| 2,3-dimethylheptane | | 0.02 |
| 2,3-dimethylheptane D/L | | 0.02 |
| 3-ethylheptane | | 0.01 |
| 4-methyloctane | 0.01 | 0.04 |
| 2-methyloctane | 0.01 | 0.05 |
| 3-methyloctane | 0.01 | |
| cis,cis-1,2,3-trimethylcyclohexane | | 0.01 |
| 3-ethylheptane | | 0.03 |
| 3-methyloctane | | 0.08 |
| cis,cis-1,2,4-trimethylcyclohexane | | 0.01 |
| orthoxylene | 0.02 | 0.01 |
| cis-1-ethyl-3-methylcyclohexane | 0.01 | 0.04 |
| trans-1-ethyl-4-methylcyclohexane | 0.01 | 0.09 |
| isobutylcyclopentane | 0.01 | 0.05 |
| 1-ethyl-1-methylcyclohexane | | 0.01 |
| cis,trans-1,2,3-trimethylcyclohexane | | 0.01 |
| trans,trans-1,2,3-trimethylcyclohexane | | 0.01 |
| n-nonane | 0.12 | 0.48 |
| trans-1-ethyl-3-methylcyclohexane | 0.01 | 0.07 |
| trans-1-ethyl-2-methylcyclohexane | | 0.02 |
| C9 naphthenes | | 0.35 |
| 2,2-dimethyloctane | | 0.07 |
| isopropylcyclohexane | | 0.04 |
| cis-1-ethyl-2-methylcyclohexane | | 0.02 |
| sec-butylcyclopentane | 0.01 | |
| 2,4-dimethyloctane | | 0.05 |
| 2,6-dimethyloctane | 0.02 | 0.18 |
| 2,5-dimethyloctane | | 0.03 |
| n-propylcyclohexane | 0.02 | 0.17 |
| n-butylcyclopentane | 0.01 | 0.05 |
| 3,5-dimethyloctane | | 0.01 |
| n-propylbenzene | 0.02 | 0.04 |
| 3,6-dimethyloctane | 0.02 | 0.10 |
| 1-methyl-3-ethylbenzene | 0.02 | 0.04 |
| 1-methyl-4-ethylbenzene | 0.01 | |
| 2,3-dimethyloctane | 0.01 | 0.08 |
| 1,3,5-trimethylbenzene | 0.02 | 0.06 |
| 4-ethyloctane | | 0.07 |

TABLE II-continued

| | Feed (weight %) | Product (weight %) |
|---|---|---|
| 5-methylnonane | 0.01 | 0.05 |
| 4-methylnonane | 0.01 | 0.13 |
| 1-methyl-2-ethylbenzene | 0.03 | 0.07 |
| 2-methylnonane | | 0.05 |
| 3-ethyloctane | 0.01 | 0.05 |
| 3-methylnonane | 0.02 | 0.17 |
| 1,2,3,5-tetramethylcyclohexane | | 0.01 |
| 1,2,3,4-tetramethylcyclohexane | 0.01 | 0.04 |
| 1,4-dimethyl-2-ethylcyclohexane | | 0.01 |
| 1,2,4-trimethylbenzene | 0.06 | 0.03 |
| cis-1-methyl-3-propylcyclohexane | 0.02 | 0.08 |
| cis-1,3-diethylcyclohexane | 0.01 | 0.12 |
| trans-1-methyl-3-propylcyclohexane | | 0.02 |
| trans-1,3-diethylcyclohexane | 0.01 | |
| 1-ethyl-2,3-dimethylcyclohexane | 0.01 | 0.04 |
| isobutylbenzene | 0.01 | 0.04 |
| cis-1-methyl-4-propylcyclohexane | | 0.02 |
| sec-butylbenzene | | 0.01 |
| n-decane | 0.03 | 0.75 |
| 1,3,5-trimethylbenzene | 0.01 | |
| 1,2,3,4-tetramethylcyclohexane | | 0.02 |
| trans-1,3-diethylcyclohexane | | 0.02 |
| 1,2,3-trimethylbenzene | | 0.01 |
| 1-methyl-3-isopropylbenzene | 0.01 | 0.02 |
| 1-methyl-4-isopropylbenzene | | 0.02 |
| 1-methyl-2-propylbenzene | | 0.01 |
| 2,3-dihydroindene | 0.01 | 0.03 |
| sec-butylcyclohexane | 0.04 | 0.04 |
| 1-methyl-2-isopropylbenzene | | 0.03 |
| butylcyclohexane | 0.01 | 0.12 |
| 1,3-diethylbenzene | 0.01 | 0.04 |
| trans-1-methyl-4-t-butylcyclohexane | 0.01 | 0.08 |
| 1-methyl-3-n-propylbenzene | 0.02 | 0.01 |
| 1-methyl-4-n-propylbenzene | 0.01 | |
| 1,4-diethylbenzene | 0.01 | |
| n-butylbenzene | 0.02 | |
| 1,3-dimethyl-5-ethylbenzene | 0.01 | 0.03 |
| 1,2-diethylbenzene | | 0.02 |
| 1-methyl-2-n-propylbenzene | 0.02 | 0.02 |
| cis-1-methyl-4-t-butylcyclohexane | 0.06 | 0.06 |
| 5-methyldecane | 0.03 | 0.04 |
| 4-methyldecane | 0.02 | 0.09 |
| 2-methyldecane | 0.02 | |
| 1,4-dimethyl-2-ethylbenzene | 0.03 | 0.09 |
| 1,3-dimethyl-4-ethylbenzene | 0.03 | 0.01 |
| 3-methyldecane | 0.02 | 0.06 |
| 1,2-dimethyl-4-ethylbenzene | 0.02 | 0.01 |
| 1,3-dimethyl-2-ethylbenzene | 0.01 | 0.02 |
| tricyclodecane | 0.03 | 0.04 |
| 1-methylindan | 0.01 | |
| 1,2-dimethyl-3-ethylbenzene | 0.03 | 0.02 |
| n-undecane | 0.63 | 0.39 |
| 1,2,4,5-tetramethylbenzene | 0.02 | 0.01 |
| 1,2,3,5-tetramethylbenzene | 0.05 | 0.03 |
| C11 unidentified | 0.10 | 0.39 |
| 4-methylindan | 0.04 | 0.02 |
| 5-methylindan | 0.03 | 0.02 |
| 1,2,3,4-tetramethylbenzene | 0.07 | 0.03 |
| 2-methylindan | 0.02 | |
| tetralin | 0.01 | 0.01 |
| 6-methylundecane | 0.03 | 0.05 |
| 5-methylundecane | 0.02 | 0.06 |
| 4-methylundecane | 0.04 | 0.05 |
| 3-methylundecane | | 0.12 |
| 2-methylundecane | 0.05 | |
| naphthalene | 0.13 | |
| naphthalene3-methylundecane | 0.05 | |
| C11 aromatic | 0.45 | 0.54 |
| n-dodecane | 0.91 | 0.40 |
| dodecanes | 0.50 | 0.58 |
| 2-methylnaphthalene | 1.19 | |
| 1-methylnaphthalene | 0.81 | |
| tridecanes | 3.30 | 2.55 |
| n-tridecane | 2.83 | 1.00 |
| tetradecanes | 6.95 | 5.01 |
| n-tetradecane | 4.47 | 1.63 |

TABLE II-continued

| | Feed (weight %) | Product (weight %) |
|---|---|---|
| pentadecanes | 9.55 | 6.52 |
| n-pentadecanes | 5.30 | 2.46 |
| hexadecanes | 10.20 | 7.20 |
| n-hexadecane | 3.57 | 2.43 |
| heptadecanes | 10.61 | 8.44 |
| n-heptadecanes | 3.60 | 3.13 |
| pristane | 1.28 | 1.78 |
| octadecanes | 7.52 | 7.46 |
| n-octadecane | 1.97 | 2.71 |
| phytane | 0.83 | 1.46 |
| nonadecanes | 5.85 | 7.20 |
| n-nonadecane | 1.77 | 2.79 |
| eicosanes | 5.63 | 7.14 |
| n-eicosane | 0.97 | 2.71 |
| heneicosanes | 4.30 | 7.35 |
| docosanes | 2.14 | 5.74 |
| tricosanes | 0.50 | 3.30 |
| tetraconsanes | 0.04 | 1.18 |
| pentacosanes | 0.01 | 0.10 |
| unidentified | | 0.16 |
| | 100.00 | 100.00 |
| Molecular Weight of Sample | 220.24 | 229.13 |
| Molecular Weight of C6 Plus | 220.24 | 230.24 |
| Density of Sample | 0.8245 | 0.8680 |
| Density of C6 Plus | 0.8245 | 0.8280 |

Further analytical results comparing the same feed and product are as follows:

Feed:

TABLE III

Further Feed Analysis

| | Paraffin | Isoparaffin | Olefin | Naphthalene | Aromatic |
|---|---|---|---|---|---|
| C4 | <0.01 | <0.01 | <0.01 | | |
| C5 | <0.01 | <0.01 | <0.01 | <0.01 | |
| C6 | 0.01 | <0.01 | <0.01 | <0.01 | <0.01 |
| C7 | 0.02 | <0.01 | <0.01 | 0.04 | 0.01 |
| C8 | 0.07 | 0.03 | <0.01 | 0.04 | 0.06 |
| C9 | 0.14 | 0.04 | <0.01 | 0.10 | 0.20 |
| C10 | 0.30 | 0.10 | <0.01 | 0.14 | 0.58 |
| C11 | 0.70 | 0.09 | | 0.07 | 2.10 |
| Total LV % | 1.24 | 0.26 | 0.00 | 0.40 | 2.95 |
| Unidentified | 95.15 | | | | |

Product:

TABLE IV

Further Product Analysis

| | Paraffin | Isoparaffin | Olefin | Naphthalene | Aromatic |
|---|---|---|---|---|---|
| C4 | <0.01 | <0.01 | <0.01 | | |
| C5 | <0.01 | <0.01 | <0.01 | <0.01 | |
| C6 | <0.01 | <0.01 | <0.01 | <0.01 | <0.01 |
| C7 | <0.01 | <0.01 | <0.01 | 0.04 | 0.18 |
| C8 | 0.04 | 0.01 | <0.01 | 0.08 | 0.03 |
| C9 | 0.55 | 0.32 | <0.01 | 1.09 | 0.28 |
| C10 | 0.85 | 1.18 | <0.01 | 0.59 | 0.51 |
| C11 | 0.43 | 0.21 | | 0.14 | 0.51 |
| Total LV % | 1.87 | 1.72 | 0.00 | 1.90 | 1.51 |
| Unidentified | 93.00 | | | | |

TABLE V

Further Feed and Product Comparison

| Test | Feed | Product |
|---|---|---|
| Gravity, API | 21.4 | 42.8 |
| Total sulfur, weight % | 0.5572 | 0.0008 |
| Total sulfur, ppm (wt) | 5,572 | 8 |
| Total sulfur, lb/bbl | 324.2 | 284.7 |
| Cetane Index | 30.0 | 64.5 |
| Copper strip | 1A | 1A |
| Flash | 230 | 124 |
| Ramsbottom Carbon | 0.38 | 0.05 |
| Viscosity | 3.5 | 3.7 |
| Color | 1.5 | <0.5 |
| Distillation, D-86 deg F | | |
| IBP | 486 | 426 |
| 5% | 488 | 493 |
| 10% | 497 | 505 |
| 20% | 509 | 517 |
| 30% | 521 | 528 |
| 40% | 534 | 540 |
| 50% | 549 | 554 |
| 60% | 566 | 568 |
| 70% | 586 | 584 |
| 80% | 608 | 601 |
| 90% | 631 | 625 |
| 95% | 654 | 644 |
| EP | 667 | 653 |
| Rec | 96.5 | 96.5 |
| Res | 1.1 | 1.8 |
| Loss | 2.4 | 1.7 |
| Middle Distillate Tests | | |
| Pour point, deg F | 10 | 25 |
| Cloud point, deg F | 20 | 34 |

The foregoing is offered primarily for purposes of illustration. Further variations in the materials, additives, operating conditions, and equipment that are still within the scope of the invention will be readily apparent to those skilled in the art.

I claim:

1. A sulfur-depleted diesel fuel, prepared by a process comprising:

(a) combining a sulfide-containing diesel fuel having a cetane index of greater than 50.0 with an aqueous fluid and a hydroperoxide and an aliphatic $C_{15}$–$C_{20}$ hydrocarbon to form a multiphase reaction medium;

(b) continuously passing said multiphase reaction medium through an ultrasound chamber in which ultrasound is applied to said multiphase reaction medium for a time sufficient to cause oxidation of sulfides in said sulfide-containing diesel fuel to sulfones;

(c) permitting said multiphase reaction medium upon emerging from said ultrasound chamber to separate spontaneously into aqueous and organic phases; and (d) isolating said organic phase from said aqueous phase, said organic phase thus isolated being said sulfur-depleted diesel fuel.

2. A sulfur-depleted diesel fuel in accordance with claim 1 in which said diesel fuel has a cetane index of greater than 60.0.

3. A sulfur-depleted diesel fuel in accordance with claim 1 in which said diesel fuel has a cetane index of from about 50.0 to about 80.0.

4. A sulfur-depleted diesel fuel in accordance with claim 1 in which said diesel fuel has a cetane index of from about 60.0 to about 70.0.

5. A sulfur-depleted diesel fuel in accordance with claim 1 in which said diesel fuel has a cetane index of from about 50.0 to about 80.0 and an API gravity of from about 30.0 to about 60.0.

6. A sulfur-depleted diesel fuel in accordance with claim 1 in which said diesel fuel has a cetane index of from about 50.0 to about 80.0 and an API gravity of from about 40.0 to about 50.0.

7. A continuous process for removing sulfides from a liquid fossil fuel, said process comprising:

(a) combining a said liquid fossil fuel with an aqueous fluid and a hydroperoxide and an aliphatic $C_{15}$–$C_{20}$ hydrocarbon to form a multiphase reaction medium;

(b) continuously passing said multiphase reaction medium through an ultrasound chamber in which ultrasound is applied to said multiphase reaction medium for a time sufficient to cause oxidation of sulfides in said sulfide-containing liquid fossil fuel to sulfones;

(c) permitting said multiphase reaction medium upon emerging from said ultrasound chamber to separate spontaneously into aqueous and organic phases; and (d) isolating said organic phase from said aqueous phase, said organic phase thus isolated being said liquid fossil fuel with sulfides removed.

8. A process in accordance with claim 7 in which said hydroperoxide is a member selected from the group consisting of hydrogen peroxide and water-soluble peroxides.

9. A process in accordance with claim 7 in which said hydroperoxide is hydrogen peroxide.

10. A process in accordance with claim 7 in which (a) comprises combining a said liquid fossil fuel with an aqueous fluid and a hydroperoxide and a petroleum fraction consisting essentially of a mixture of aliphatic $C_5$–$C_{20}$ hydrocarbons having a specific gravity of at least about 0.82.

11. A process in accordance with claim 10 in which said mixture of aliphatic $C_{15}$–$C_{20}$ hydrocarbons has a specific gravity of at least about 0.85.

12. A process in accordance with claim 10 in which said mixture of aliphatic $C_5$–$C_{20}$ hydrocarbons is heavy mineral oil.

13. A process in accordance with claim 7 further comprising contacting said multiphase reaction medium with a transition metal catalyst during application of ultrasound.

14. A process in accordance with claim 13 further in which said transition metal catalyst is a member selected from the group consisting of metals having atomic numbers of 21 through 29, 39 through 47, and 57 through 79.

15. A process in accordance with claim 13 farther in which said transition metal catalyst is a member selected from the group consisting of nickel, silver, tungsten, and combinations thereof.

16. A process in accordance with claim 7 in which step (a) comprises combining said liquid fossil fuel and said aqueous fluid at a (fossil fuel):(aqueous fluid) volume ratio of from about 8:1 to about 1:5.

17. A process in accordance with claim 7 in which step (a) comprises combining said liquid fossil fuel and said aqueous fluid at a (fossil fuel):(aqueous fluid) volume ratio of from about 5:1 to about 1:1.

18. A process in accordance with claim 7 in which step (a) comprises combining said liquid fossil fuel and said aqueous fluid at a (fossil fuel):(aqueous fluid) volume ratio of from about 4:1 to about 2:1.

19. A process in accordance with claim 12 in which the volume ratio of said mineral oil to said liquid fossil fuel is from about 0.00003 to about 0.003.

20. A process in accordance with claim 7 in which said fossil fuel is diesel fuel, and said process further comprises preheating said diesel fuel to a temperature of at least about 70° C. prior to combining said diesel fuel with said aqueous fluid.

21. A process in accordance with claim 20 in which said diesel fuel is preheated to a temperature of from about 70° C. to about 80° C. prior to combining said diesel fuel with said aqueous fluid.

22. A process in accordance with claim 7 in which said liquid fossil fuel is a member selected from the group consisting of crude oil, shale oil, diesel fuel, gasoline, kerosene, liquefied petroleum gas, and petroleum residuum-based fuel oils.

23. A process in accordance with claim 7 in which said multiphase reaction medium has a residence time in said ultrasound chamber of from about 0.3 minute to about 30 minutes.

24. A process in accordance with claim 7 in which said multiphase reaction medium has a residence time in said ultrasound chamber of from about 0.5 minute to about 5 minutes.

25. A sulfur-depleted diesel fuel, prepared by a process comprising:

(a) combining a sulfide-containing diesel fuel having an API gravity greater than 30.0 with an aqueous fluid and a hydroperoxide and an aliphatic $C_5$–$C_{20}$ hydrocarbon to form a multiphase reaction medium;

(b) continuously passing said multiphase reaction medium through an ultrasound chamber in which ultrasound is applied to said multiphase reaction medium for a time sufficient to cause oxidation of sulfides in said sulfide-containing diesel fuel to sulfones;

(c) permitting said multiphase reaction medium upon emerging from said ultrasound chamber to separate spontaneously into aqueous and organic phases; and (d) isolating said organic phase from said aqueous phase, said organic phase thus isolated being said sulfur-depleted diesel fuel.

26. A sulfur-depleted diesel fuel in accordance with claim 25 in which said diesel fuel has an API gravity greater than 40.0.

27. A sulfur-depleted diesel fuel in accordance with claim 25 in which said diesel fuel has an API gravity of from about 30.0 to about 60.0.

28. A sulfur-depleted diesel fuel in accordance with claim 25 in which said diesel fuel has an API gravity of from about 40.0 to about 50.0.

* * * * *